US005932297A

United States Patent [19]

Tatsuno et al.

[11] Patent Number: 5,932,297

[45] Date of Patent: Aug. 3, 1999

[54] METHOD FOR FORMATION OF COATING FILM

[75] Inventors: Tadayoshi Tatsuno; Toru Hayase, both of Hiratsuka, Japan

[73] Assignee: Kansai Paint Co., Ltd., Hyogo, Japan

[21] Appl. No.: 08/875,727

[22] PCT Filed: Dec. 2, 1996

[86] PCT No.: PCT/JP96/03521

§ 371 Date: Aug. 4, 1997

§ 102(e) Date: Aug. 4, 1997

[87] PCT Pub. No.: WO97/20642

PCT Pub. Date: Jun. 12, 1997

[30] Foreign Application Priority Data

Dec. 6, 1995 [JP] Japan ..... 7-317881

[51] Int. Cl.[6] ..... B05D 1/02; B05D 3/02; B05D 3/06

[52] U.S. Cl. ..... 427/493; 427/498; 427/512; 427/517; 427/521; 427/386; 427/421

[58] Field of Search ..... 427/493, 496, 427/498, 508, 512, 517, 521, 386, 421

[56] References Cited

U.S. PATENT DOCUMENTS

| | | | |
|---|---|---|---|
| 4,246,298 | 1/1981 | Guarney et al. | 427/46 |
| 4,868,288 | 9/1989 | Meier | 534/15 |
| 5,242,715 | 9/1993 | Schoen et al. | 427/386 |
| 5,416,173 | 5/1995 | Gagiiani et al. | 525/526 |

FOREIGN PATENT DOCUMENTS

| | | |
|---|---|---|
| 60-084303 | 5/1985 | Japan . |
| 63-178127 | 7/1988 | Japan . |
| 04-011626 | 1/1992 | Japan . |
| 06-025368 | 2/1994 | Japan . |
| 1321263 | 6/1973 | United Kingdom . |

*Primary Examiner*—Erma Cameron
*Attorney, Agent, or Firm*—Wenderoth, Lind & Ponack, L.L.P.

[57] ABSTRACT

The present invention provides a method for forming a coating film, which comprises ejecting a curable coating composition from a spray gun, spray-coating the ejected composition while applying thereto an active energy beam, and heat-curing the resulting coating film, wherein the curable coating composition contains an epoxy group-containing resin (A) and a photo-induced cationic polymerization initiator (B).

10 Claims, No Drawings

METHOD FOR FORMATION OF COATING FILM

TECHNICAL FIELD

The present invention relates to a method for forming a coating film. More particularly, the present invention relates to a method for forming a coating film by using a heat- and active energy beam-curable coating composition, which method can give a coating film of improved fluidity without adversely affecting various properties of the coating film.

BACKGROUND ART

Conventional thermosetting coatings contain a fluidity-controlling agent in order to control the fluidity of coating and give a coating film of smooth surface and also to substantially eliminate the sagging of coating applied on a vertical plane. As the fluidity-controlling agent, various types are known. Generally and widely used are, for example, inorganic additives such as AEROSIL, Bentone and the like; polyamide compounds such as Disparlon (trade name, a product of Kusumoto Chemicals, Ltd.) and the like; diurea compounds obtained by the reaction of a diisocyanate compound and a primary amine; and finely divided gelled polymers.

These fluidity-controlling agents have influences on the rheology and physical properties of coating composition and, as a result, can improve the spraying efficiency of coating, the sagging-preventability of coating film, the pattern controllability of metallic pigment, etc. On the other hand, the fluidity-controlling agents have had problems in that they reduce the finish appearance (e.g. luster) of coating film, the intercoat adhesion when a plurality of coatings are applied in layers, and the water resistance of coating film.

In order to alleviate the above problems when a conventional fluidity-controlling agent is used, coating methods were proposed which comprises ejecting a curable coating composition from a spray gun and spray-coating the ejected composition while applying an active energy beam thereto. In these methods, the curable coating composition has a low viscosity right after injection but has a high viscosity when coated on a material to be coated, whereby sagging of coating from the coated material can be prevented.

For example, in JP-A-6-65523 is disclosed a coating method which comprises, in coating, on a material to be coated, a high-solid coating containing an acrylic resin, a heat-crosslinking agent, a photopolymerizing monomer (which has a double bond in the molecule and can be polymerized by an electromagnetic wave), a photopolymerization initiator and an organic solvent, ejecting the high-solid coating from a spray gun and spray-coating the injected coating while applying a given electromagnetic wave to the coating.

Also, in JP-A-7-70471 is disclosed a coating method which comprises spraying, on a material to be coated, a high-solid coating containing a macromonomer having an ethylenically unsaturated bond at one end and a photopolymerization initiator, while applying an ultraviolet light to the coating particles formed by spraying and flying in the air.

These methods can certainly prevent sagging. They, however, have a problem of no applicability as a top clear for automobiles, for the following reason. In the above methods, since a photo-induced radical polymerization reaction is utilized, the polymerization reaction of double bonds is easily hinderd by the presence of oxygen; consequently, the double bonds remain in the coating film formed, which tends to allow the film to have various defects, for example, reduced weatherability and yellowing.

DISCLOSURE OF THE INVENTION

The present inventors made an extensive study in order to solve the above-mentioned problems. As a result, the present inventors found out that the problems can be solved by using, as a coating composition, a curable coating composition containing an epoxy group-containing resin and a photo-induced cationic polymerization initiator and curing the composition with an active energy beam and a heat. The present invention has been completed based on the above finding.

According to the present invention, there is provided a method for forming a coating film, which comprises ejecting a curable coating composition from a spray gun, spray-coating the ejected composition while applying thereto an active energy beam, and heat-curing the resulting coating film, wherein the curable coating composition contains an epoxy group-containing resin (A) and a photo-induced cationic polymerization initiator (B).

In the method of the present invention, a curable coating composition containing an epoxy group-containing resin capable of giving rise to photo-induced cationic polymerization and a photo-induced cationic polymerization initiator (the composition is hereinafter referred to as the coating composition of the present invention) is ejected from a spray gun toward a material to be coated; the ejected coating composition is spray-coated on the material to be coated while an active energy beam is applied to the ejected coating composition; then, the resulting coating film is heat-cured to obtain a cured coating film. According to the present method, the ejected coating composition, when coated on the material to be coated, is already cured partially by the active energy beam applied and has an increased viscosity; therefore, no sagging of coating from the coated material takes place; the successive heating of the formed film accelerates the curing of the film; thereby, a cured film having excellent finish appearance can be formed.

Moreover, in the present method, it is not necessary to use, in the curable coating composition, any resin having double bonds; consequently, the coating film formed from the curable coating composition can be free from various defects (for example, reduced weatherability and yellowing) caused by the undesirable double bonds remaining in the coating film; therefore, the method of the present invention can be applied even in top clear coating for automobiles and has a high industrial advantage.

The method of the present invention is described below in more detail.

Epoxy Resin-Containing Resin (A)

The epoxy group-containing resin (A) used in the present invention is a polymer which has, on an average, at least about one epoxy group in the molecule but has substantially no polymerizable double bonds. Specific examples thereof are an epoxy group-containing acrylic resin and an epoxy group-containing polyester resin.

The epoxy group-containing acrylic resin can be obtained, for example, by copolymerizing an epoxy group-containing radical-polymerizable unsaturated monomer with an acrylic monomer and, optionally, other radical-polymerizable unsaturated monomer.

The epoxy group-containing radical-polymerizable unsaturated monomer usable in production of the epoxy group-containing acrylic resin includes, for example, glycidyl (meth)acrylate, allyl glycidyl ether and 3,4-epoxycyclohexylmethyl (meth)acrylate.

The acrylic monomer copolymerizable with the epoxy group-containing radical-polymerizable unsaturated monomer includes, for example, alkyl or cycloalkyl (meth) acrylates such as methyl (meth)acrylate, ethyl (meth) acrylate, butyl (meth)acrylate, 2-ethylhexyl (meth)acrylate, lauryl (meth)acrylate, cyclohexyl (meth)acrylate and the like; hydroxyalkyl (meth)acrylates such as hydroxyethyl (meth)acrylate, hydroxypropyl (meth)acrylate, hydroxybutyl (meth)acrylate and the like; fluoroalkyl (meth)acrylates such as perfluorooctylethyl (meth)acrylate, perfluoroisononylethyl (meth)acrylate and the like; (meth)acrylic acid; (meth)acrylonitrile; and acrylamides such as acrylamide, N-methylolacrylamide, N-butoxymethylacrylamide and the like. The other radical-polymerizable unsaturated monomer usable optionally includes, for example, vinyl aromatic compounds such as styrene, α-methylstyrene, vinyltoluene and the like; olefins which may contain fluorine, such as ethylene, propylene, ethylene trifluoride, ethylene tetrafluoride and the like; vinyl compounds such as vinyl chloride, vinyl acetate and the like; carboxyl group-containing unsaturated monomers such as itaconic acid, fumaric acid, maleic acid and the like; silane compounds such as γ-(meth) acryloyloxypropyltrimethoxysilane, γ-(meth) acryloyloxypropyltriethoxysilane, γ-(meth) acryloyloxypropylmethyldimethoxysilane, vinyltrimethoxysilane, vinyltriethoxysilane, vinyltris-(β-methoxyethoxy)silane and the like; and vinyl ethers such as butyl vinyl ether, cyclohexyl vinyl ether and the like. These monomers can be appropriately selected, combined and used so as to satisfy the properties required for the epoxy group-containing acrylic resin formed.

The copolymerization of the above-mentioned monomers can be conducted by various processes which are known per se, such as solution polymerization process, suspension polymerization process, bulk polymerization process, emulsion polymerization process and the like. The epoxy group-containing acrylic resin obtained can have a number-average molecular weight of generally about 1,500–100,000, preferably about 2,000–80,000. The epoxy group-containing acrylic resin can contain, besides the epoxy group, a functional group(s) which take(s) part in the crosslinking reaction of the resin during its heat-curing, such as hydroxyl group, carboxyl group, hydrolyzable silyl group (silanol group) and/or the like.

The epoxy group-containing polyester resin can be obtained, for example, by reacting a functional group-containing polyester resin formed before hand, with an epoxy compound having a functional group reactive with the functional group of the polyester resin. It can be produced specifically, for example, by reacting a hydroxyl group-containing polyester resin with an epoxy compound having a functional group reactive with hydroxyl group, such as γ-glycidoxypropyltrimethoxysilane, β-(3,4-epoxycyclohexyl)ethyltrimethoxysilane or the like. The epoxy group-containing polyester resin can contain, besides the epoxy group, a functional group(s) which contribute(s) to the cross-linking reaction of the resin during its heat-curing, such as hydroxyl group, carboxyl group, hydrolyzable silyl group (silanol group) and/or the like.

The epoxy group-containing polyester resin can have a number-average molecular weight of generally about 1,000–50,000, preferably about 2,000–30,000.

The epoxy group-containing acrylic resin and the epoxy group-containing polyester resin can be used in admixture thereof, or there can be used a graft resin obtained by grafting one of them to the other. However, use of the epoxy group-containing acrylic resin is preferable.

The epoxy group content in the epoxy group-containing resin (A) used in the present invention is not particularly restricted and can be varied depending upon the kind of the resin used, other conditions, etc.; however, the epoxy group content is suitably in a range of generally about 150 to about 30,000, preferably about 200 to about 1,000 in terms of epoxy equivalents.

The epoxy resin (A) preferably contains, besides the epoxy group, a crosslinkable functional group(s) such as hydroxyl group., carboxyl group, hydrolyzable silyl group (silanol group) and/or the like.

Photo-Induced Cationic Polymerization Initiator (B)

The photo-induced cationic polymerization initiator (B) used in the present coating composition is a compound which generates a cation upon irradiation with an active energy beam and allows the epoxy group-containing resin (A) to give rise to epoxy group ring opening and cationic polymerization. It includes, for example, hexafluoroantimonate salts, pentafluorohydroxyantimonate salts, hexafluorophosphate salts, hexafluoroarsenate salts and other photo-induced cationic polymerization initiators, all represented by the following formulas:

$$Ar_2I^+.X^- \quad (I)$$

(wherein Ar is an aryl group, for example, a phenyl group; and $X^-$ is $PF_6^-$, $SbF_6^-$ or $AsF_6^-$), $$Ar_3S^+.X^- \quad (II)$$

(wherein Ar and $X^-$ have the same definitions as given above), (III)

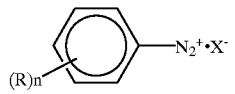

(wherein R is an alkyl group having 1–12 carbon atoms or an alkoxy group having 1–12 carbon atoms; n is an integer of 0–3; and $X^-$ has the same definition as given above), (IV)

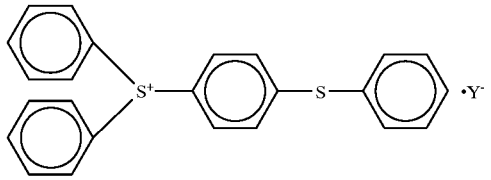

(wherein $Y^-$ is $PF_6^-$, $SbF_6^-$, $AsF_6^-$ or $SbF_5(OH)^-$), (V)

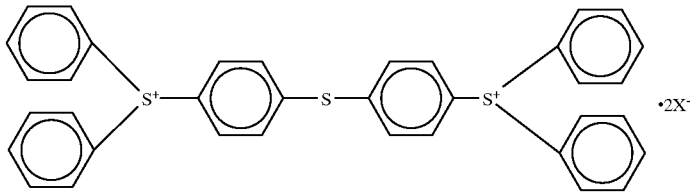

(wherein $X^-$ has the same definition as given above), (VI)

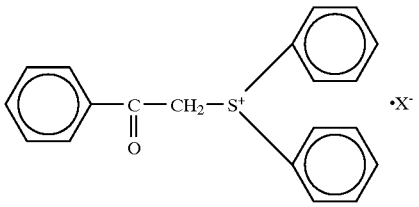

(wherein $X^-$ has the same definition as given above), (VII)

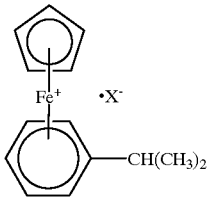

(wherein $X^-$ has the same definition as given above), (VIII)

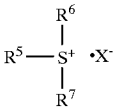

(wherein $R^5$ is an aralkyl group having 7–15 carbon atoms or an alkenyl group having 3–9 carbon atoms; $R^6$ is a hydrocarbon group having 1–7 carbon atoms or a hydroxyphenyl group; $R^7$ is an alkyl group having 1–5 carbon atoms which may have an oxygen atom or a sulfur atom; and $X^-$ has the same definition as given above), (IX)

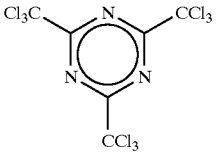

-continued (X)

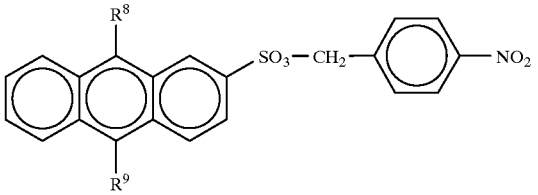

(wherein $R^8$ and $R^9$ are each independently an alkyl group of 1–12 carbon atoms or an alkoxy group having 1–12 carbon atoms), (XI)

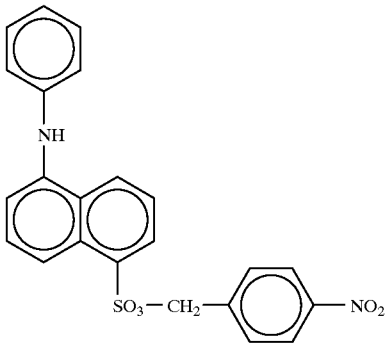

(XII)

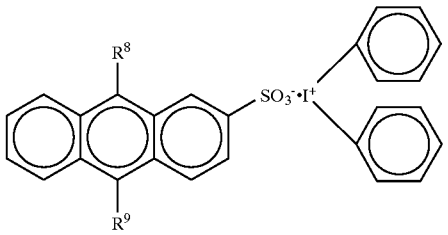

(wherein $R^8$ and $R^9$ have the same definitions as given above), (XIII)

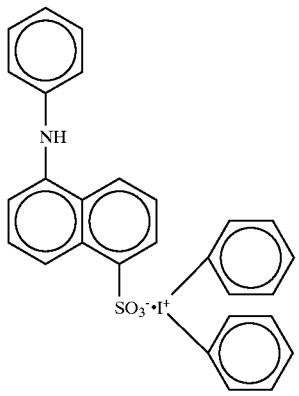

(XIV)

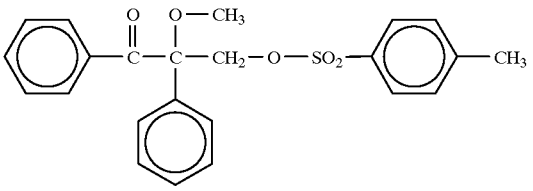

(XV)

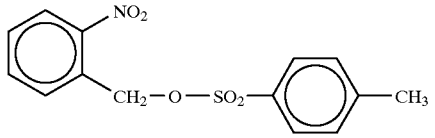

Some of the above-mentioned photo-induced cationic polymerization initiators (B) are commercially available under the trade names of, for example, Cyracure UVI-6970 and Cyracure UVI-6990 (products of Union Carbide Corp. of U.S.), Irgacure 264 (a product of Ciba-Geigy Corp.) and CIT-1682 (a product of Nippon Soda Co., Ltd.). Of the above compounds, salts containing $PF_6^-$ as an anion are preferable in view of the toxicity and general usability.

In the coating composition of the present invention, the amount of the photo-induced cationic polymerization initiator (B) used can be varied depending upon the kind of the initiator, etc. but can be generally 0.01–20 parts by weight, preferably 0.1–10 parts by weight per 100 parts by weight (as solid content) of the epoxy group-containing resin (A). When the amount of the photo-induced cationic polymerization initiator (B) used is less than 0.01 part by weight, the amount of the cation generated is small and the curing reaction by cationic polymerization does not proceed sufficiently. Meanwhile, when the amount is more than 20 parts by weight, the efficiency of cationic polymerization reaches a saturation point, inviting an extra cost.

Curable Coating Composition

The coating composition of the present invention basically contains the above-mentioned epoxy group-containing resin (A) and the above-mentioned photo-induced cationic polymerization initiator (B). The present coating composition may further contain, as necessary, for example, a crosslinking agent such as melamine resin, blocked isocyanate or the like. The present coating composition may further contain, as necessary, a heat-curing catalyst in order to accelerate the heat-curing of the epoxy group-containing resin (A). The heat-curing catalyst usable is as follows. The catalyst effective for the crosslinking reaction between carboxyl group and epoxy group includes, for example, quaternary salt catalysts such as tetraethylammonium bromide, tetrabutylammonium bromide, tetraethylammonium chloride, tetrabutylphosphonium bromide, triphenylbenzylphosphonium chloride and the like; and amines such as triethylamine, tributylamine and the like. Of these, quaternary salt catalysts are preferable. A mixture of the quaternary salt and about the same equivalent of a phosphorus compound such as dibutyl phosphate or the like is more preferable because it can impart improved storage stability to the resulting coating without impairing its curability and moreover can prevent reduction in electrical resistance of coating (that is, reduction in spray coatability of coating).

The catalyst effective for the crosslinking reaction of hydrolyzable silyl group (silanol group) includes tin catalysts such as dibutyltin dilaurate, dibutyltin diacetate and the like; titanium-based catalysts such as tetrabutyl titanate and the like; and amines such as triethylamine, tributylamine and the like.

The catalyst effective for the crosslinking reaction between hydroxyl group and isocyanate includes, for example, metal catalysts such as bismuth nitrate, lead 2-ethylhexanoate, lead benzoate, lead oleate, sodium trichlorophenolate, sodium propionate, lithium acetate, potassium oleate, tetrabutyltin, tributyltin chloride, dibutyltin dichloride, butyltin trichloride, tin chloride, tributyltin o-phenolate, tributyltin cyanate, tin octylate, tin oleate, tin oxalate, dibutyltin di(2-ethylhexylate), dibenzyltin di(2-ethylhexylate), dibutyltin dilaurate, dibutyltin diisooctylmaleate, dibutyltin sulfide, dibutyltin dibutoxide, dibutyltin bis(o-phenylphenolate), dibutyltin bis (acetylacetonate), di(2-ethylhexyl)tin oxide, titanium tetrachloride, dibutyltitanium dichloride, tetrabutyl titanate, butoxytitanium trichloride, iron trichloride, iron (III) 2-ethylhexanoate, iron (III) acetylacetonate, ferrocene, antimony trichloride, antimony pentachloride, triphenylantimony dichloride, triphenylantimony, uranium nitrate, cadmium nitrate, cadmium diethyldithiophosphate, cobalt benzoate, cobalt 2-ethylhexanoate, thorium nitrate, triphenylaluminum, trioctylaluminum, aluminum oleate, diphenylmercury, zinc 2-ethylhexanoate, zinc naphthenate, nickelocene, hexacarbonylmolybdenum, cerium nitrate, vanadium trichloride, copper 2-ethylhexanoate, copper acetate, manganese 2-ethylhexanoate, zirconium 2-ethylhexanoate, zirconium naphthenate, triphenylarsenic, arsenic trichloride, boron trifluoride-diethyl ether complex, pyridine borane, calcium acetate, barium acetate and the like.

The catalyst effective for the crosslinking reaction between hydroxyl group and amino group includes, for example, sulfonic acids such as p-toluene-sulfonic acid, dodecylbenzenesulfonic acid, dinonylnaphthalenedisulfonic acid and the like; phosphoric acids such as dibutyl phosphate and the like; and adducts between the above acid and epoxy compound.

The above curing catalysts can be used singly or in combination.

The amount of the crosslinking agent or the heat-curing catalyst used is not particularly restricted and can be varied depending upon the kind thereof, the kind of functional group contained therein, etc. However, the appropriate amount of the crosslinking agent used is generally 3–100 parts by weight, preferably 5–50 parts by weight per 100 parts by weight (as solid content) of the epoxy group-containing resin (A); and the appropriate amount of the heat-curing catalyst used is generally 0.05–5 parts by weight, preferably 0.1–3 parts by weight per 100 parts by weight (as solid content) of the epoxy group-containing resin (A).

The coating composition of the present invention may further contain, as necessary, a so-called dehydrating agent such as trimethyl orthoacetate or the like in order to suppress the deterioration of coating caused by the water present in the solvent contained therein and air. The present coating composition may further contain, as necessary, pigments generally used in coatings, such as coloring pigment, extender pigment, rust-preventive pigment and the like.

The coating composition of the present invention may further contain, as necessary, for example, various resins such as polyester resin, alkyd resin, silicone resin, fluororesin and the like and a non-aqueous particulate polymer in such amounts that the curing of coating film is not substantially impaired. The present coating composition may further contain, as necessary, ordinary additives used in coatings such as ultraviolet absorber, oxidation inhibitor, surface conditioner, antifoaming agent and the like.

The coating composition of the present invention is used ordinarily as an organic solvent type coating composition. As the solvent, there can be used various organic solvents for coatings, for example, an aromatic or aliphatic hydrocarbon solvent, an alcohol type solvent, an ester type solvent, a ketone type solvent and an ether type solvent. The organic solvent usable may be the solvent per se which are used in production of the resin used, or may be added later as necessary. The solid content of the present coating composition is not particularly restricted as long as the composition can be spray-coated, but can be generally about 20–90% by weight, preferably about 30–60% by weight.

Formation of Coating Film

The method for formation of coating film according to the present invention is carried out by, in spray-coating a coating composition onto a material to be coated, using, as the coating composition, the above-mentioned heat- and active energy beam-curable coating composition, ejecting the composition from a spray gun, and spray-coating the injected composition onto the material while applying an active energy beam to the ejected composition.

The spray coating can be conducted by electrostatic spray coating, non-electrostatic spray coating or the like, all known per se. The application of the active energy beam can be conducted to the coating particles formed by spraying and present in the air and/or to the coating adhered to the substrate, simultaneously with the adhesion. The active energy beam includes an ultraviolet light and an electron beam; and the source thereof includes, for example, a mercury lamp, a xenon lamp, a carbon arc, a metal halide lamp and sunlight. The dose of the active energy beam applied can be determined depending upon the thickening tendency of coating composition and is generally set at a level at which the coating applied on a vertical wall does not show sagging. The dose is specifically about 100–3,000 $mj/m^2$ in the case of an ultraviolet light, and about 2–3 Mrad in the case of an electron beam.

The coating film formed by spray coating is then heat-cured (baked). This heat-curing can completely cure the coating film which is partially cured by the application of an active energy beam. The conditions of the heat-curing differ depending upon the coating composition used, etc., but appropriately are generally about 110–200° C., preferably about 130–150° C. for about 10–60 minutes.

Thus, the present method can form a coating film superior in finish appearance, curability, etc.

EXAMPLES

The present invention is hereinafter described more specifically by showing Examples. In the Examples, parts and % are by weight.

Production Example 1

Production of Epoxy Group-Containing Acrylic Resin (a-1)

410 parts of xylene and 77 parts of n-butanol were fed into a 5-liter glass-made flask equipped with a stirrer, a thermometer and a cooling tube, and were heated to 125° C. using an electric mantle. Thereto was dropwise added a mixture having the following monomer composition, at a constant rate at that temperature in 4 hours. Incidentally, azobisisobutyronitrile is a polymerization initiator.

| | |
|---|---|
| Glycidyl methacrylate | 432 parts (30%) |
| n-Butyl acrylate | 720 parts (50%) |
| Styrene | 288 parts (20%) |
| Azobisisobutyronitrile | 72 parts |

The resulting mixture was subjected to aging for 30 minutes. Thereto was dropwise added, in 2 hours, a mixture of 90 parts of xylene, 40 parts of n-butanol and 14.4 parts of azobisisobutyronitrile, followed by aging for 2 hours, to obtain a solution of an epoxy group-containing acrylic resin (a-1) at a final conversion of 100%.

The polymer solution obtained had a polymer solid content of 70% and a Gardner viscosity of S at 25° C., and the polymer had a number-average molecular weight of 3,000.

Production Example 2

Production of Alicyclic Epoxy Group-Containing Acrylic Resin (a-2)

A solution of an alicyclic epoxy group-containing acrylic resin (a-2) was obtained at a final conversion of 100% in the same manner as in Example 1 except that the monomer composition was changed to the following.

| | |
|---|---|
| 3,4-Epoxycyclohexylmethyl methacrylate | 432 parts (30%) |
| Styrene | 288 parts (20%) |
| n-Butyl acrylate | 720 parts (50%) |

The polymer solution obtained had a polymer solid content of 70% and a Gardner viscosity of Q at 25° C., and the polymer had a number-average molecular weight of 3,000.

Production Example 3

Production of Half Ester Group-Containing Acrylic Resin (a-3)

553 parts of xylene and 276 parts of 3-methoxybutyl acetate were fed into a 5-liter glass-made flask equipped with a stirrer, a thermometer and a cooling tube, and were heated to 125° C. using an electric mantle. Thereto was dropwise added a mixture having the following monomer composition, at a constant rate at that temperature in 4 hours. Incidentally, p-tert-butyl peroxy-2-ethylhexanoate is a polymerization initiator.

| | |
|---|---|
| Methanol half ester of maleic anhydride | 288 parts (20%) |
| 4-Hydroxy-n-butyl acrylate | 288 parts (20%) |
| n-Butyl acrylate | 576 parts (40%) |
| Styrene | 288 parts (20%) |
| p-tert-Butyl peroxy-2-ethylhexanoate | 72 parts |

The resulting mixture was subjected to aging for 30 minutes. Thereto was dropwise added, in 2 hours, a mixture of 277 parts of 3-methoxybutyl acetate and 14.4 parts of p-tert-butyl peroxy-2-ethylhexanoate, followed by aging for 2 hours, to obtain a solution of a half ester group-containing acrylic resin (a-3) at a final conversion of 98%.

The polymer solution obtained had a polymer solid content of 55% and a Gardner viscosity of M at 25° C., and the polymer had a number-average molecular weight of 3,500 and an acid value of 86 mg KOH/g.

Production Example 4

Production of Epoxy Group- and Hydroxyl Group-Containing Acrylic Resin (a-4)

A solution of an epoxy group- and hydroxyl group-containing acrylic resin (a-4) was obtained at a final conversion of 100% in the same manner as in Example 1 except that the monomer composition was changed to the following.

| | |
|---|---|
| Glycidyl methacrylate | 432 parts (30%) |
| 4-Hydroxy-n-butyl acrylate | 288 parts (20%) |
| n-Butyl acrylate | 432 parts (30%) |
| Styrene | 288 parts (20%) |

The polymer solution obtained had a polymer solid content of 70% and a Gardner viscosity of U at 25° C., and the polymer had a number-average molecular weight of 3,000.

Production Example 5

Production of Hydroxyl Group-Containing Acrylic Resin (a-5)

A solution of a hydroxyl group-containing acrylic resin (a-5) was obtained at a final conversion of 100% in the same manner as in Example 1 except that the monomer composition was changed to the following.

| | |
|---|---|
| 4-Hydroxy-n-butyl acrylate | 432 parts (30%) |
| n-Butyl acrylate | 576 parts (40%) |
| Styrene | 432 parts (30%) |

The polymer solution obtained had a polymer solid content of 70% and a Gardner viscosity of U at 25° C., and the polymer had a number-average molecular weight of 2,000.

Production Example 6

Production of Epoxy Group-, Hydroxyl Group- and Hydrolyzable Alkoxysilyl Group-Containing Acrylic Resin (a-6)

A solution of an epoxy group-, hydroxyl group- and hydrolyzable alkoxysilyl group-containing acrylic resin (a-6) was obtained at a final conversion of 100% in the same manner as in Example 1 except that the monomer composition was changed to the following.

| | |
|---|---|
| Glycidyl methacrylate | 504 parts (35%) |
| 4-Hydroxy-n-butyl acrylate | 216 parts (15%) |
| γ-Methacryloxypropyl-triethoxysilane | 216 parts (15%) |
| n-Butyl acrylate | 216 parts (15%) |
| Styrene | 288 parts (20%) |

The polymer solution obtained had a polymer solid content of 70% and a Gardner viscosity of V at 25° C., and the polymer had a number-average molecular weight of 2,000.

Production Example 7

Production of Coatings

Various resin solutions were prepared at compounding ratios (solid contents) shown in Table 1 which appears later. To each solution were added 1 part of Tinuvin 900 (trade name, a product of Ciba-Geigy Corp., an ultraviolet absorber) and 0.1 part of BYK-300 (trade name, a product of BYK-Chemie Japan K.K., a surface conditioner). Each of the resulting mixtures was diluted with Swasol 1000 (trade name, a product of Cosmo Oil Co., Ltd., a hydrocarbon solvent), followed by viscosity adjustment to 25 seconds as measured by Ford Cup #4 at 20° C., to produce various clear coatings to be used in the present invention.

In Table 1, (*1) a-7: a macromonomer having a number-average molecular weight of 2,500, having a methacryloyl group at one end (monomer composition: methyl methacrylate/2-hydroxyethyl methacrylate=80/20)

(*2) UVI-6990: Cyracure UVI-6990 (trade name, a product of Union Carbide Corp., a photo-induced cationic polymerization initiator having $PF_6^-$)

D-1173: DAROCURE 1173 (trade name, a product of Ciba-Geigy Japan Limited, a photopolymerization initiator)

(*3) Cymel 202: (trade name, a product of Mitsui Cytec Ltd., a melamine resin having a resin solid content of 80%)

SBL 3175: Sumidur BL 3175 (trade name, a product of Sumitomo Bayer Urethane Co., Ltd., a blocked isocyanate having a resin solid content of 75%)

(*4) ①: an equimolar mixture of tetrabutylammonium bromide and monobutyl phosphate ②: Dodecylbenzenesulfonic acid ③: Dibutyltin dilaurate ④: Tetrabutyl titanate Examples 1–8 and Comparative Examples 1–3

Cationic electrocoating and intermediate coating were applied to a dull steel plate of 0.8 mm (thickness)×300 mm×100 mm which had been subjected to a zinc phosphate treatment. The resulting coated plate was used as a base material and subjected to the following coating test.

Maximum Sagging-Free Film Thickness

The base material was set vertically. One of the above-produced clear coatings was ejected from a spray gun (provided at a distance of 30 cm from the base material) and spray-coated onto the base material by gradient coating so that the thickness of the resulting coating film increased gradually. In Examples 1–8 and Comparative Examples 2–3, an ultraviolet light was applied to the coating which was in the air from the ejection to the arrival at the base material, by the use of a high-pressure mercury lamp (8 kw) provided at a distance of 40 cm from the center of the base material; however, in Comparative Example 1, no ultraviolet light was applied. The thus-obtained coated plate was placed vertically in a hot-air furnace and subjected to baking at 140° C. for 30 minutes. Then, the resulting plate was observed visually. As a result, the minimum film thickness at which sagging was seen in the coating film of the plate after baking, was taken as the maximum sagging-free film thickness of the clear coating used.

Separately, the base material was placed horizontally. Thereto was spray-coated one of the clear coatings so that the film thickness became 30μ as cured. The coated plate was subjected to baking in a hot-air furnace at 140° C. for 30 minutes. Then, the following tests were conducted.

Film Appearance

The surface of coating film was observed visually and evaluated according to the following standard.

O: No abnormality is seen.

Δ: Slight shrinkage and/or slight fog is seen.

X: Conspicuous shrinkage and/or conspicuous fog is seen.

Curability

The surface of coating film was rubbed 10 times with a gauze impregnated with xylol, and then observed and evaluated according to the following standard.

O: The coating film surface shows no change.

Δ: Flow is clearly seen on the coating film surface.

X: The coating film surface shows swelling and tends to show whitening.

Weatherability

Measured by a QUV accelerated exposure test using an accelerated weathering tester manufactured by Q Panel Co.

A cycle conducted under the following test conditions:

ultraviolet application 16 H/60° C.

water condensation 8 H/50° C.

was repeated for 3,000 hours (125 cycles). The coating film after the test was evaluated according to the following standard.

O: The coating film has substantially the same luster as before test.

Δ: The coating film shows luster reduction and whitening.

X: The coating film shows luster reduction, cracking and whitening strikingly.

The test results are shown in Table 1.

TABLE 1

| | | Examples | | | | | | | | Comparative Examples | | |
|---|---|---|---|---|---|---|---|---|---|---|---|---|
| | | 1 | 2 | 3 | 4 | 5 | 6 | 7 | 8 | 1 | 2 | 3 |
| Compounding | | | | | | | | | | | | |
| Epoxy group-containing resin (A) (*1) | a-1 | 60 | | | | | | | | 60 | 60 | 40 |
| | a-2 | | 60 | | | | | | | | | |
| | a-3 | 40 | 40 | 40 | | | | | | 40 | 40 | 40 |
| | a-4 | | | 60 | 20 | 70 | 20 | 70 | | | | |
| | a-5 | | | | 50 | | 50 | | | | | |
| | a-6 | | | | | | | | 100 | | | |
| | a-7 | | | | | | | | | | | 20 |
| Photo-induced cationic polymerization initiator (B) (*2) | UVI-6990 | 5 | 5 | 5 | 5 | 5 | 5 | 5 | 5 | 5 | | |
| | D-1173 | | | | | | | | | | | 5 |
| Crosslinking agent (*3) | Cymel 202 | | | | 30 | 30 | | | | | | |
| | SBL 3175 | | | | | | 30 | 30 | | | | |
| Heat-curing catalyst (*4) | ① | 2 | 2 | 2 | | | | | | 2 | 2 | 2 |
| | ② | | | | 1 | 1 | | | | | | |
| | ③ | | | | | | 0.5 | 0.5 | | | | |
| | ④ | | | | | | | | 1 | | | |
| Application of ultraviolet light | | Yes | Yes | Yes | Yes | Yes | Yes | Yes | Yes | No | Yes | Yes |
| Evaluation | | | | | | | | | | | | |
| Maximum sagging-free film thickness (μm) | | 60 | 62 | 65 | 58 | 59 | 61 | 60 | 59 | 22 | 20 | 60 |
| Film appearance | | ○ | ○ | ○ | ○ | ○ | ○ | ○ | ○ | ○ | ○ | Δ |
| Curability | | ○ | ○ | ○ | ○ | ○ | ○ | ○ | ○ | X | Δ | Δ |
| Weatherability | | ○ | ○ | ○ | ○ | ○ | ○ | ○ | ○ | Δ | Δ | X |

We claim:

1. A method for forming a coating film comprising ejecting a curable coating composition from a spray gun, exposing the ejected curable coating composition to an active energy beam, coating the ejected and exposed curable coating composition to form a coating film, and heat curing the coating film, wherein the curable composition comprises an epoxy group-containing resin (A) and a photo-induced cationic polymerization initiator (B).

2. The method according to claim 1, wherein the epoxy group-containing resin (A) has epoxy equivalents of 150–3,000.

3. The method according to claim 1, wherein the epoxy group-containing resin (A) contains a crosslinkable functional group in addition to the epoxy group.

4. The method according to claim 1, wherein the epoxy group-containing resin (A) is an epoxy group-containing acrylic resin.

5. The method according to claim 1, wherein the photo-induced cationic polymerization initiator (B) is selected from the group consisting of a hexafluoroantimonate salt, a pentafluorohydroxyantimonate salt, a hexafluorophosphate salt and a hexafluoroarsenate salt.

6. The method according to claim 1, wherein the curable coating composition contains the photo-induced cationic polymerization initiator (B) in an amount of 0.01–20 parts by weight per 100 parts by weight as solid of the epoxy group-containing resin.

7. The method according to claim 1, wherein the curable coating composition further contains a cross-linking agent and/or a heat-curing catalyst.

8. The method according to claim 1, wherein the active energy beam is an ultraviolet light or an electron beam.

9. The method according to claim 1, wherein the coating film formed by spray-coating is heat-cured at a temperature of 110–200° C.

10. The coated article obtained by a method set forth in claim 1.

* * * * *